United States Patent [19]

Colvin

[11] Patent Number: 4,903,554

[45] Date of Patent: Feb. 27, 1990

[54] REVERSIBLE RATCHET WRENCH WITH THIN HEAD CONSTRUCTION

[76] Inventor: David S. Colvin, 23933 Haynes, Farmington Hills, Mich. 48018

[21] Appl. No.: 293,547

[22] Filed: Jan. 4, 1989

Related U.S. Application Data

[63] Continuation of Ser. No. 203,621, Jun. 2, 1988, abandoned, which is a continuation-in-part of Ser. No. 914,336, Oct. 2, 1986, abandoned, which is a continuation-in-part of Ser. No. 675,431, Nov. 27, 1984, Pat. No. 4,631,988, which is a continuation-in-part of Ser. No. 461,242, Jan. 26, 1983, Pat. No. 4,485,700.

[51] Int. Cl.[4] ..... B25B 13/46

[52] U.S. Cl. ..... 81/63; 81/63.2

[58] Field of Search ..... 81/60–63.2, 81/58.1; 192/43, 43.2

[56] References Cited

U.S. PATENT DOCUMENTS

| | | | |
|---|---|---|---|
| 2,764,048 | 9/1956 | Thompson | 81/60 |
| 2,891,434 | 6/1959 | Lozensky | 81/60 |
| 2,957,377 | 10/1960 | Hare | 81/63 |
| 3,713,356 | 1/1973 | Knudsen | 81/62 |
| 4,274,311 | 6/1981 | Ebert | 81/63 |
| 4,485,700 | 12/1984 | Colvin | 81/63 |
| 4,631,988 | 12/1986 | Colvin | 81/63 |

*Primary Examiner*—Judy Hartman

*Attorney, Agent, or Firm*—Brooks & Kushman

[57] ABSTRACT

A reversible ratchet wrench (10) includes a wrench body (11) having a unitary head (12,12') including a driver opening (20) and pawl recess (24). A driver (26) having a ratchet portion (28) received within the driver opening (20) includes ratchet teeth (30) located between oppositely facing first and second planar surfaces (16,18) of the wrench head. A pawl (38) is received within the pawl recess (24) of the opening (20) and includes pawl teeth (**40*a*,40*b*) that extend between the first planar surface (16) and a pawl skirt (25) that closes the pawl recess (24) adjacent the second planar surface (8). The ratchet and pawl teeth (30 and 40*a*,40*b*) have continuous engagement between the wrench head surfaces (16,18) to selectively lock the driver in one direction and permit ratcheting in the other direction. Driver opening (20) and pawl recess (24) of the wrench head (12) have cylindrical shapes which facilitate manufacturing and the support of both the driver and the pawl upon assembly. A ball (34) of a releasable detent mechanism (35) is provided to secure a socket to a driving tang (32) of the driver (26). A tab (42) of a pawl (38) is provided for changing the direction of locking, and a spring biaser (44) operates on the pawl to maintain the pawl teeth (40*a* or 40*b*) in engagement with the ratchet teeth (30) on the driver (26**) in order to provide locking in one direction and ratcheting in the other direction.

13 Claims, 3 Drawing Sheets

Fig. 1
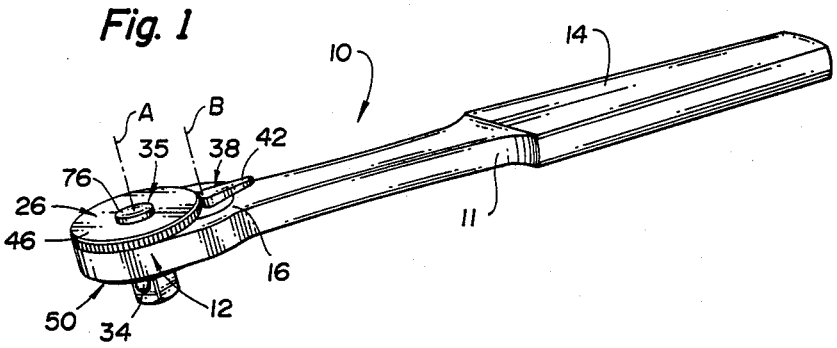
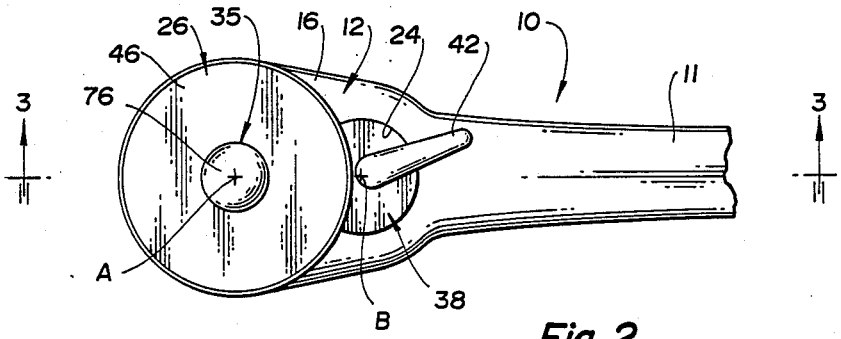
Fig. 2
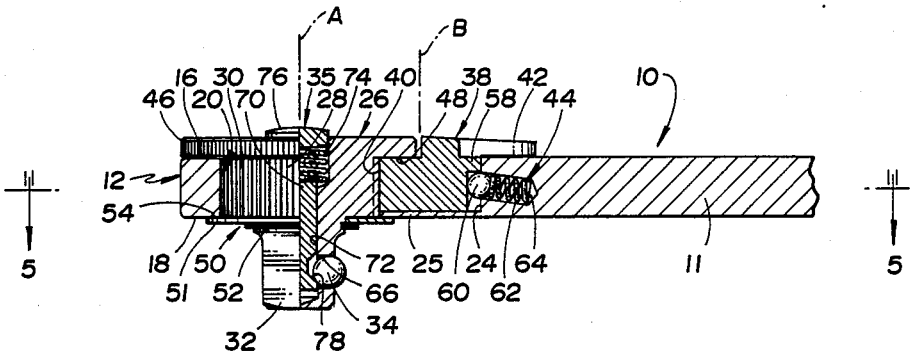
Fig. 3

REVERSIBLE RATCHET WRENCH WITH THIN HEAD CONSTRUCTION

This is a continuation of Ser. No. 07/203,621, filed 6/2/88, now abandoned; which was a CIP of Ser. No. 06/914,336, filed 10/2/86, now abandoned; which was a CIP of Ser. No. 06/675,431, filed 11/27/84, now patent No. 4,631,988; which was a CIP of Ser. No. 05/461,242, filed 1/26/83, now patent No. 4,485,700.

TECHNICAL FIELD

This invention relates to a reversible ratchet wrench used to selectively apply torque in opposite directions to either tighten or loosen a nut or a bolt head.

BACKGROUND ART

Reversible ratchet wrenches are utilized to selectively apply torque in either direction to tighten or loosen a nut or a bolt head. A head of the wrench conventionally includes a driving tang that is connected to a socket which engages the nut or bolt head. Application of a force to a handle of the wrench pivots the head to rotatively drive the socket in one direction, while application of a force in the opposite direction produces a ratcheting that permits the torquing to be performed in a stroking manner without disengagement of the socket from the nut or bolt head.

Conventional reversible ratchet wrenches include a rotatable driver on which a driving tang is provided to drive the socket. A pawl mounted on the head engages teeth of the driver to prevent rotation of the driver in one direction while permitting rotation thereof in the other direction by a ratcheting operation. Conventionally, the driver and the pawl include teeth that are located between spaced portions of the wrench head such that the teeth do not extend to one or the other oppositely facing surfaces of the head. It is to provide the teeth with greater lengths in order to increase the torque which can be applied through the pawl and driver teeth, but such an increase is limited by the fact that the head cannot be made too large or it will not be able to fit into confined locations.

One type of conventional ratchet wrench has overlapping driver and pawl openings in the head. The pawl is usually of a multiple piece construction and is retained at one end by a pawl skirt and at the other end by a retaining ring located in an annular recess in the pawl opening. The driver is retained by a driver skirt at one end and by a retaining ring, located in an annular recess in the driver opening, on the other end. However, other ratchet wrenches of this type have employed retaining plates, located in retaining plate recesses in the head, to retain both the driver and pawl within the wrench head. This construction prohibits the ratchet teeth from extending to either the upper or lower surfaces of the wrench head and adds significant weight and thickness to the wrench head and requires complex and relatively expensive machining operations.

Other ratchet wrenches of this type have included overlapping cylindrical driver and pawl openings which extend the full thickness of the wrench head. Although this type of construction allows for a relatively thin head, it has demonstrated: a distinct lack of rotational support for both the pawl and driver, causing excessive play in the relationship between the components allowing for a misalignment between the driver and pawl in high torque applications; poor results in drop and has a significant susceptibility to dirt and grease, all of which adversely effect both performance and durability.

Other types of reversible ratchet wrenches have a pawl which is mounted on the driver by a pin for pivotal movement to provide the selective engagement with teeth located in the driver opening of the head to provide locking thereof against rotation in one direction and ratcheting thereof in the other direction. However, such pawls have also previously been slidably mounted on the head by a slideway such that rectilinear pawl movement reverses the directions in which the locking and ratcheting take place.

Conventional reversible ratchet wrenches are usually somewhat complex and require a head having a counterbored opening with annular recesses for securing a retaining ring in order to receive and rotatably support the driver with the driving tang thereof projecting outwardly from the head. Such counterbored and recessed openings with annular recesses increase the thickness of the wrench head and are relatively expensive to machine and thus add to the cost of the wrench.

Reversible ratchet wrenches of the type discussed above and other similar wrenches are disclosed by U.S. Pat. Nos.: 376,584; 1,138,276; 1,140,167; 1,147,476; 1,854,513; 1,868,839; 1,957,462: 2,542,241; 2,658,416; 2,680,983; 2,686,446: 2,701,977: 2,720,127; 2,725,722; 2,891,434: 2,943,523; 2,982,169; 2,957,377; 2,978,081; 3,096,659; 3,140,625; 3,145,594; 3,233,481; 3,299,725; 3,369,416; 3,448,641; 3,724,298; 3,754,486; 3,967,514; 4,147,076; 4,274,311; 4,277,990; 4,300,413; 4,308,769; 4,324,158; 4,328,720; 4,336,728; and RE 23,661; and by French Pat. No. 1,029,033.

DISCLOSURE OF THE INVENTION

An object of the present invention is to provide an improved reversible ratchet wrench which has an uncomplicated construction so as to provide a relatively thin head which is economical to manufacture while still being of high strength and effective in use.

Other objects of the present invention are to provide a reversible ratchet wrench that has improved performance, is less susceptible to dirt and grease, and has improved durability, relative to other thin head ratchets.

In carrying out the above object, the reversible ratchet wrench includes a head and a handle extending from the head to permit the application of torque during use. The head has first and second oppositely facing planar surfaces that define the maximum thickness thereof and the head also includes a driver opening that extends between the surfaces. A pawl recess in the first planar surface of the head overlaps the driver opening a slight extent and the driver opening and the pawl recess respectively receive a driver which has a round ratchet portion and a pawl. A pawl skirt closes the pawl recess adjacent the second planar surface of the head. The driver and pawl are respectively supported within the driver opening and the pawl recess for rotation about driving and pawl axes. Teeth on the round ratchet portion of the driver and on the pawl are engageable to prevent rotation of the driver with respect to the head in one direction or the other depending upon the pawl position. A driving tang is provided on the driver and projects outwardly from the head along the driving axis to provide rotational connection to a socket that is driven by the wrench. A detent mechanism is also preferably incorporated in the wrench and includes a ball mounted for inward and outward movement on the driving tang of the driver. This detent mechanism also includes a detent member that is spring biased on the driver to normally force the ball outwardly to retain the socket on the driving tang. The detent member is movable to permit inward movement of the ball in order to release the socket on the driving tang. A tab on the pawl permits rotation thereof about the pawl axis to change the direction of locking the driver against rotation. Engagement of the pawl teeth with the ratchet teeth on the driver is provided by a spring biaser that provides a preferred means for positioning the pawl to prevent rotation of the driver in one direction or the other while permitting rotation of the driver in the opposite direction by ratcheting of the pawl.

In accordance with one feature of the invention, the teeth on the ratchet portion of the driver extend between the one planar surfaces of the head and the pawl skirt. The pawl has teeth extending from the first planar surface of the head parallel and have ends that terminate at the pawl skirt in a spaced planar surface. These pawl teeth the driving axis to provide engagement with the teeth on the driver. Such engagement of the teeth for the full distance between the first planar surface of the head and the pawl skirt permits the wrench to carry a large amount of torque while still having a relatively thin construction. This construction of the ratchet head allows it to: operate in confined spaces; be manufactured with less material than conventional ratchet wrenches and at far less cost; be less susceptible to dirt and grease; and have improved performance relative to other thin head ratchets.

In accordance with another feature of the invention, the reversible ratchet wrench has the circular driver portion and pawl recess provided with cylindrical shapes extending between the first surface of the head and pawl skirt. A pair of retaining surfaces on the driver engage the oppositely facing surfaces of the head and one of the retaining surfaces also engages one planar surface of the pawl to rotatably support the driver and pawl on the head. This construction of the wrench provides an uncomplicated but effective and economical way for mounting of the driver and the pawl on the head.

In accordance with yet another feature of the invention, a driver skirt extends radially inward toward the driving axis from the periphery of the driver opening at the second planar surface of the head. In this embodiment, both the teeth on the ratchet portion of the driver and the teeth on the pawl extend parallel to the driving axis from the first planar surface of the head to the driver skirt and pawl skirt, respectively. This construction of the ratchet head provides for continuous engagement of the teeth and also permits the wrench to carry a large amount of torque while still having a relatively thin construction.

In the preferred construction of the wrench, the head of the wrench body and the handle of the wrench are made unitary with each other in any suitable manner such as stamping or forging. The driver opening through the head has a larger size than the pawl recess and is located distally on the head from the handle. The pawl and the tab that rotates the pawl also have a unitary construction and can be made in any suitable manner.

In its preferred construction, the pawl includes a pair of positioning surfaces that are defined by a pair of notches against which the spring biaser acts to provide overcenter positioning of the pawl for selective locking of the driver in either direction. A pawl cover skirt is positioned on the upper planar surface of the pawl to cover the positioning surfaces. Each of the positioning surfaces is disclosed as having a flat shape to define the notches between the pawl cover skirt and pawl skirt, however other shapes may be employed.

In its preferred construction, the spring biaser includes a ball and a spring that biases the ball against the positioning surfaces of the pawl to provide the overcenter positioning of the pawl. A hole is provided in the head of the wrench body extending from the pawl portion of the opening toward the handle. The spring of the biaser is preferably of the helical compression type and has one end seated by the hole and another end that is seated by the ball to provide the biasing of the ball against the pawl for the overcenter positioning of the pawl.

The driver also includes a flange having a retaining surface that engages one surface of the head as well as engaging the pawl. A retainer on the driver has a retaining surface that engages the other surface of the head. Cooperation of the driver flange and the retainer retains both the driver and the pawl on the head within the driver opening and the pawl recess for reversible ratcheting operation.

The preferred construction of the detent mechanism includes a helical compression spring through which the detent member extends. This helical compression spring has a first end that is seated by the driver and a second end that is seated the detent member to provide the biasing thereof that forces the ball outwardly. The upper portion of the detent member is manually depressed to allow for inward ball movement. The opposite end of the detent member has an annular recess in which the ball is received and by which the ball is moved outwardly or permitted to move inwardly.

The objects, features, and advantages of the present invention are readily apparent from the following detailed description of the best mode for carrying out the invention when taken in connection with the accompanying drawings.

BRIEF DESCRIPTION OF THE DRAWINGS

FIG. 1 is a perspective view of a reversible ratchet wrench that is constructed in accordance with the present invention;

FIG. 2 is a plan view of the wrench;

FIG. 3 is a longitudinal sectional view of the wrench taken along the direction of line 3—3 in FIG. 2;

BEST MODE FOR CARRYING OUT THE INVENTION

Figure 8:
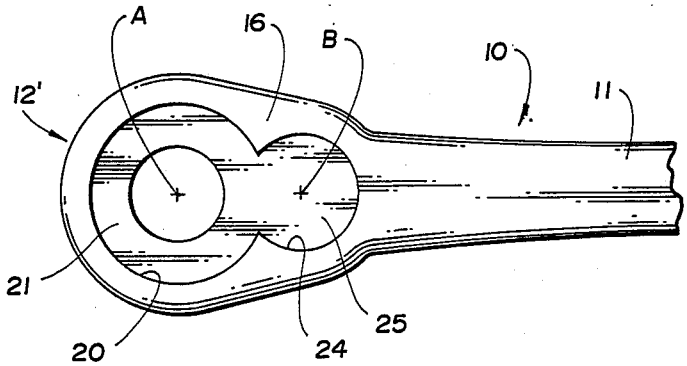
FIG. 8 is a plan view of another construction of the wrench head which has a driver skirt and the pawl skirt.
Figure 9:
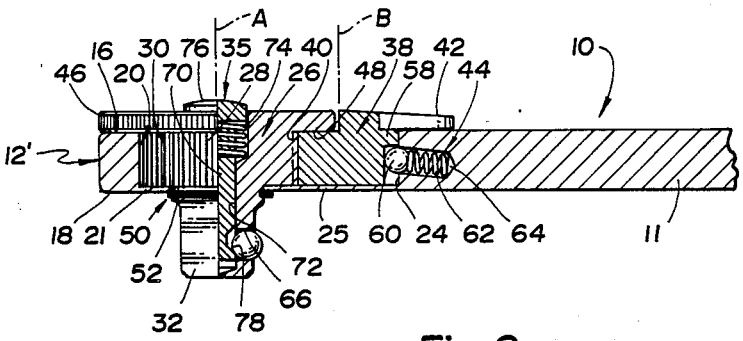
FIG. 9 is a longitudinal sectional view of the wrench similar to FIG. 3 but illustrating the wrench embodiment having the driver skirt.

With reference to FIGS. 1 and 3 of the drawings, a reversible ratchet wrench constructed in accordance with the present invention is generally indicated by 10 and includes a wrench body 11 having a unitary head 12 and a handle 14 that extends from the head to permit the application of torque during use of the wrench. Wrench head 12 has first and second oppositely facing planar surfaces 16 and 18 which extend parallel to each other as seen in FIG. 3 and define the maximum thickness of the wrench head. In accordance with a first embodiment of the invention, the head 12 includes a circular driver opening 20 extending between the planar surfaces 16 and 18, illustrated in FIGS. 4 through 7, and a pawl recess 24 of a partially circular shape in the first planar surface 16 that overlaps the circular driver portion 20 a slight extent. In accordance with a second embodiment of the invention, the head 12' includes the circular driver opening 20, as illustrated in FIGS. 8 and 9, having a driver skirt 21 as best seen in FIG. 8 extending radially inward from the periphery of the driver opening at the second planar surface 18. In this embodiment, the head also includes pawl recess 24. Both embodiments of the ratchet wrench 10 are otherwise similar in structure and include a pawl skirt 25 that closes the pawl recess 24 adjacent the second planar surface 18 of the head.

It should be noted that the pawl skirt 25 of the FIG. 3 embodiment and the driver and pawl skirts 21 and 25 of the FIG. 9 embodiment should have a thickness no greater than 25% of the thickness between the wrench head surfaces 16 and 18. This is necessary to provide a sufficient length of the engaged ratchet and pawl teeth to transmit torque. Most preferably the skirt thickness will be in the range of about 8% to 15% of the head thickness when taking into consideration torque transmission and manufacturing considerations, which will be on the order of about 20 to 40 thousandths of an inch in skirt thickness for most conventional size wrenches.

Figure 4:
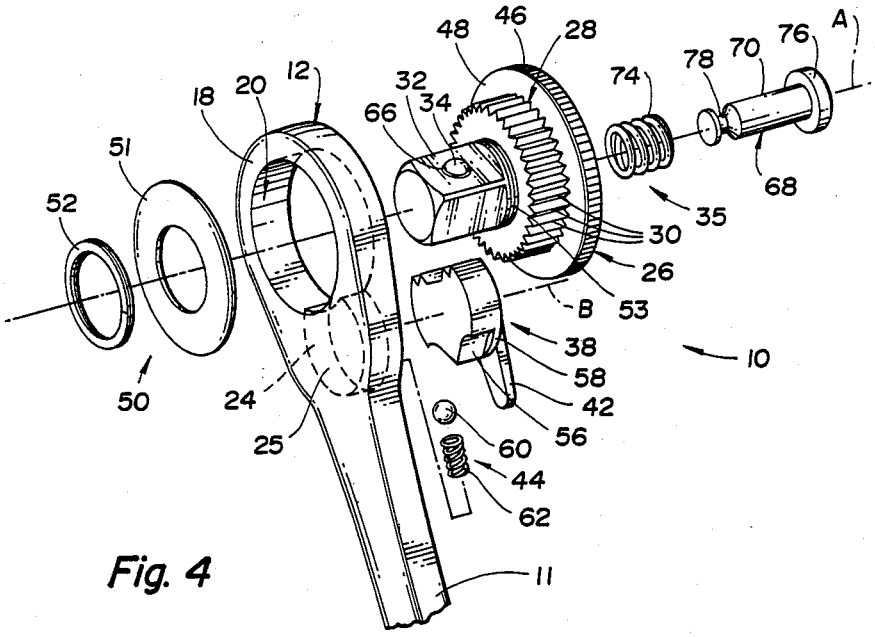
FIG. 4 is an exploded perspective view that illustrates the construction of a head of the wrench.
Figure 5:
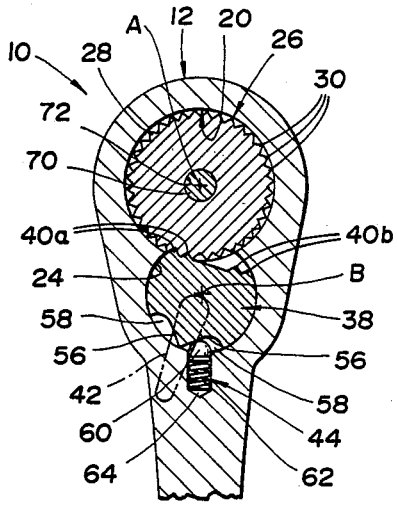
FIG. 5 is a sectional view taken along the direction of line 5—5 in FIG. 3 and illustrates the wrench locked against rotation in one direction but free to ratchet in the other direction.
Figure 6:
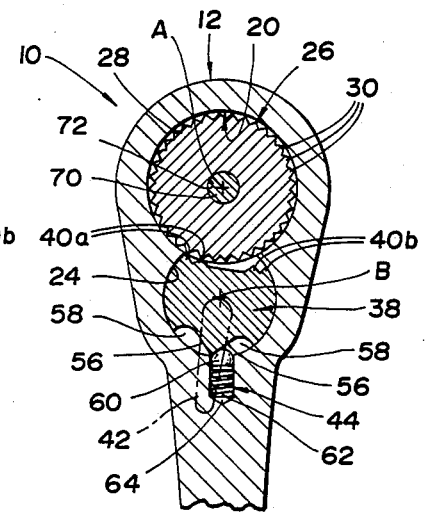
FIG. 6 is a view similar to FIG. 5 but illustrating the wrench as ratcheting operation takes place.
Figure 7:
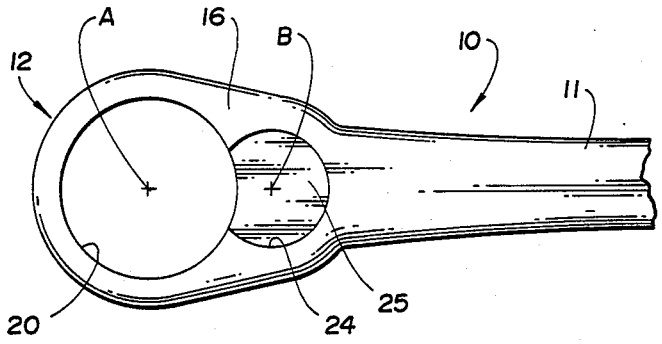
FIG. 7 is a plan view of one construction of the wrench head which has a driver opening and a pawl skirt.

A driver 26 of the wrench 10 has a round ratchet portion 28 that is received within the circular driver opening 20 as illustrated in FIGS. 5 and 6 so as to be supported for rotation about a driving axis A. Ratchet teeth 30 of the driver ratchet portion 28 are spaced about the axis A about which the driver rotates. A driving portion of driver 26 is embodied by a driving tang 32 that projects along axis A as illustrated in FIGS. 3 and 4 to provide connection of the driver to a socket with which the wrench is used to tighten or loosen a nut or a bolt head. Driving tang 32 includes a spring biased ball detent 34 of a detent mechanism 35 which, as is hereinafter more fully described, is utilized to secure or release the socket to or from the driving tang.

A generally round pawl 38 is received within the pawl portion 24 of the opening 20 and as illustrated in FIGS. 5 and 6 is supported for rotation about a pawl axis B that is spaced from the driver axis A extending in a parallel relationship. Pawl 38 includes spaced teeth **40*a* and 40*b* that are selectively engaged with the ratchet teeth 30 of the ratchet portion 28 of driver 26 in order to prevent rotation of the driver with respect to the head 12 in one direction or the other depending upon the position of the pawl. These pawl teeth extend without interruption from the first planar surface 16 of the wrench head to the pawl skirt 25 and have ends that terminate at the pawl skirt in a spaced relationship to the second planar surface 18 of the wrench head. A tab 42 of the pawl 38 is engaged by the thumb of the wrench operator to rotate the pawl about axis B and thereby engage either the pawl teeth 40*a* or 40*b* with the ratchet teeth 30 in order to change the direction of locking of the driver against rotation. A spring biaser 44 operates on the pawl 38 in a manner which is hereinafter more fully described to provide a preferred means for maintaining the pawl teeth 40*a* or 40*b* in engagement with the ratchet teeth 30 on the driver 26** to prevent rotation thereof in one direction or the other while permitting rotation of the driver in the opposite direction by ratcheting of the pawl.

The first embodiment of the invention is best illustrated in FIG. 3 where the ratchet teeth 30 are shown extending continuously without interruption between the one planar surface 16 and the pawl skirt 25 of the wrench head 12. FIG. 9 best illustrates the second embodiment of the invention where ratchet teeth 30 extend continuously without interruption between the first planar surface 16 and the driver skirt 21 of the wrench head 12'. In both FIGS. 3 and 9, the pawl teeth **40*a,b* extend continuously between the first planar surface 16 and the pawl skirt 25 and have continuous uninterrupted engagement with the ratchet teeth 30 of the driver 26** to provide locking of the driver against rotation in one direction and ratcheting thereof in the other direction. This permits the wrench to carry a relatively large amount of torque while still having a thin construction that can be used in confined spaces. In addition, the ratchet wrench can be manufactured with less material than conventional ratchet wrenches and at far less cost.

As also illustrated in FIG. 3 and in FIG. 4 as well, the circular driver opening 20 and pawl recess 24 of head 12 have cylindrical shapes, the driver opening extending between the oppositely facing surfaces 16 and 18 of the wrench head 12 and the pawl recess extending between the first planar surface and the pawl skirt. This construction allows the ratchet wrench 10 to be easily manufactured by a stamping or forging operation and also has particular utility in providing the support for the driver and pawl.

With reference to FIG. 5, the wrench 10 is illustrated with the pawl teeth **40*a* engaged with the ratchet teeth 30 to prevent rotation of the driver 26 in a counterclockwise direction with respect to the wrench head 12. Movement of the driver 26 in a clockwise direction with respect to wrench head 12 is then permitted by ratcheting of the pawl teeth 40*a* over the teeth 30 as shown in FIG. 6. Spring biaser 44 compresses to permit pawl movement that allows the ratcheting. Such ratcheting permits reciprocal stroking of the wrench handle 14** without disengagement of the associated socket from the nut or bolt head being rotated.

Pawl 38 including pawl tab 42 is movable to the position illustrated in FIG. 6 to initially disengage the pawl teeth **40*a* from the ratchet teeth 30 to permit ratcheting of the ratchet wrench 10. Continued counterclockwise rotation of the pawl 38 by means of pawl tab 42 engages the pawl teeth 40*b* with the ratchet teeth in order to prevent clockwise rotation of the driver 26 with respect to the wrench head 12** and to permit ratcheting in the counterclockwise direction.

Driver 26 includes a flange 46 that has a retaining surface 48 for engaging the first surface 16 of the wrench head 12 as shown in FIG. 3. A two piece retainer 50 of the wrench includes a retaining washer 51 and a retaining ring 52 that is received by an annular groove 53 in driver 26 to position the retaining washer 52 with a retaining surface 54 thereof engaged with the other surface 18 of the wrench head 12 as shown in FIG. 3. Retaining surfaces 48 and 54 thus cooperate to retain the ratchet portion 28 of the driver 26 within the driver opening 20 in the wrench head. Retaining surface 48 and the pawl skirt 25 directly engage the opposite sides of pawl 38 to cooperate in retaining the pawl within the pawl recess 24 of the wrench head 12. In the assembled condition, the driving tang 32 projects along the driver axis A outwardly past the second surface 18 of the wrench head.

In the preferred construction, the head 12 and handle 14 of the wrench body 11 are made unitary with each other by a stamping or forging operation. The driver opening 20 has a larger size than the pawl recess 24 as shown in FIGS. 4 through 6 and is located in a distal direction from the unitary handle 14 as illustrated in FIGS. 1 through 3. Pawl 38 and its operating tab 42 are also preferably made with a unitary construction in any suitable manner.

As shown in FIGS. 5 and 6, the pawl 38 includes a pair of positioning surfaces 56 against which the spring biaser 44 acts to provide overcenter positioning of the pawl that engages either the pawl teeth 40*a* or 40*b* with the ratchet teeth 30. As seen in FIGS. 3 and 4, pawl 38 has a pawl cover skirt 58 below which the positioning surfaces 56 are located and hidden from sight with the wrench 10 is in its assembled condition. Each of the positioning surfaces 56 has a flat shape defining an associated notch between the spaced skirt 58 and the pawl skirt 25.

As illustrated in FIGS. 5 and 6, the spring biaser 44 includes a ball 60 and a spring 62 that biases the ball against the notches 56 of the pawl 38 to provide the overcenter positioning of the pawl. The head 12 of the wrench body 11 includes a hole 64 that extends from the pawl recess 24 toward the handle of the wrench 10. Spring 62 is of the helical compression type and has one end seated by the hole 64 and has another end that seats the ball 60 to provide biasing of the ball toward the pawl 38 in order to provide the overcenter positioning of the pawl. It will be noted in FIG. 3 that the hole 64 is preferably drilled at an angle such that a straight drilling operation can be used.

As illustrated by combined reference to FIGS. 3 and 4, the detent mechanism 35 includes the detent ball 34 previously mentioned which is received within a transverse bore 66 in the driving tang 32. The outer end of bore 66 is closed slightly so as to capture the detent ball 34 within the bore while permitting limited inward and outward movement with respect to the driving axis A. Detent mechanism 35 also includes a detent member 68 that is spring biased on the driver to normally force the detent ball 34 outwardly such that a portion of the ball sticks out through the outer end of bore 66 to retain a socket on the driving tang 32. Manual depression of the detent member 68 permits inward movement of the detent ball 34 in order to release the socket from the driving tang 32.

Detent member 68 of the detent mechanism 35 includes a pin 70 that is received within a bore 72 in the driver 26 cocentric with the driving axis A. A helical compression spring 74 of the detent mechanism 35 is located within an enlarged upper end in the driver bore 72 as illustrated in FIG. 3. Pin 70 extends through the helical compression spring 74 which has a first end that is seated by an intermediate horizontal shoulder of the bore 72 and a second end that is seated by a release button 76 of the detent member 68. Opposite the release button 76, the pin 70 has an end including an annular recess 78 in which the ball 34 is received and by which the ball is moved outwardly or permitted to move inwardly.

The bias of spring 74 normally raises the release button 76 which causes the annular recess 78 to force the detent ball 34 outwardly. Thumb or other manual actuation of the release button 76 forces the detent member 68 downwardly against the bias of the spring 74 to align the recess 78 with the driving tang bore 66 in order to permit inward movement of the ball 34 that releases the socket held by the driving tang 32. Release of the release button 76 then allows the spring 74 to again force the detent ball 34 outwardly to secure the socket.

While the best mode for carrying out the invention has been described in detail, those familiar with the art to which this invention relates will recognize various alternative designs and embodiments for practicing the invention as defined by the following claims.

What is claimed is:

1. A reversible ratchet wrench comprising: a wrench body including a unitary head and a handle extending from the head; the unitary head having first and second oppositely facing planar surfaces that define the maximum thickness of the head; the head also having a circular driver opening extending between the planar surfaces; a pawl recess of a partially circular shape in the first planar surface adjacent the driver opening; the head having a pawl skirt that is unitary therewith and closes the pawl recess adjacent the second planar surface; a driver having a round ratchet portion received within the circular driver opening of the head and supported for rotation about a driving axis; the ratchet portion of the driver having teeth that extend parallel to the driving axis without interruption the entire distance between the first planar surface and the pawl skirt of the unitary head; the driver also including a driving portion; a pawl received within the pawl recess and supported for rotation about a pawl axis between at least two positions; the pawl having oppositely facing planar surfaces and also having spaced teeth for selectively engaging the teeth of the ratchet portion of the driver to prevent rotation thereof with respect to the head in one direction or the other depending upon the pawl position; the pawl teeth extending parallel to the driving axis to provide engagement there of with the teeth on the ratchet portion of the driver; the pawl teeth extending the entire distance without interruption from the first planar surface of the wrench head to the pawl skirt and having ends that terminate at the pawl skirt in a spaced relationship to the second planar surface of the wrench head; the pawl having a tab for providing rotation thereof to change the direction of locking of the driver against rotation; the driver including a flange rotatable therewith with respect to the head and having a planar surface that engages the first planar surface of the head around the circular driver opening thereof and also directly engages one planar surface of the pawl; a retainer on the driver; the retainer having a planar surface for engaging the second planar surface of the head such that the driver flange and the retainer cooperate to retain the driver within the circular opening and the pawl within the pawl recess; and means for maintaining the pawl teeth in engagement with the ratchet teeth on the driver to prevent rotation thereof in one direction or the other while permitting rotation of the driver in the opposite direction by ratcheting of the pawl.

2. A reversible ratchet wrench comprising: a wrench body including a unitary head and a handle extending from the head; the unitary head having first and second oppositely facing planar surfaces that define the maximum thickness of the head; the head also having a circular driver opening extending between the planar surfaces; a pawl recess of a partially circular shape in the first planar surface adjacent the driver opening; the head having a pawl skirt that is unitary therewith and closes the pawl recess adjacent the second planar surface; a driver skirt extending radially inward toward a driving axis from the periphery of the driver opening at the second planar surface of the head; a driver having a round ratchet portion received within the circular driver opening of the head and supported for rotation about the driving axis; the ratchet portion of the driver having teeth that extend parallel to the driving axis without interruption the entire distance between the first planar surface of the head and the pawl and driver skirts; the driver also including a driving portion; a pawl received within the pawl recess and supported for rotation about a pawl axis between at least two positions; the pawl having oppositely facing planar surfaces and also having spaced teeth for selectively engaging the teeth of the ratchet portion of the driver to prevent rotation thereof with respect to the head in one direction or the other depending upon the pawl position; the pawl teeth extending parallel to the driving axis to provide engagement thereof with the teeth on the ratchet portion of the driver; the pawl teeth extending the entire distance without interruption from the first planar surface of the wrench head to the pawl skirt and having ends that terminate at the pawl skirt in a spaced relationship to the second planar surface of the wrench head; the pawl having a tab for providing rotation thereof to change the direction of locking of the driver against rotation; the driver including a flange rotatable therewith with respect to the head and having a planar surface that engages the first planar surface of the head around the circular driver opening thereof and also directly engages one planar surface of the pawl; a retainer on the driver; the retainer having a planar surface for engaging the second planar surface of the head such that the driver flange and the retainer cooperate to retain the driver within the circular opening and the pawl within the pawl recess; and means for maintaining the pawl teeth in engagement with the ratchet teeth on the driver to prevent rotation thereof in one direction or the other while permitting rotation of the driver in the opposite direction by ratcheting the pawl.

3. A ratchet wrench as in claim 1 or 2 wherein said means comprises a spring biaser, the pawl including a pair of positioning surfaces against which the spring biaser acts to provide overcenter positioning of the pawl, and the pawl having a cover skirt under which the positioning surfaces are located and hidden from sight.

4. A ratchet wrench as in claim 3 wherein the spring biaser includes a ball and a helical compression spring that biases the ball against the positioning surfaces of the pawl to provide the overcenter positioning of the pawl.

5. A ratchet wrench as in claim 4 wherein the head of the wrench body and the handle of the wrench are unitary with each other, the circular driver opening having a larger size than the pawl recess.

6. A ratchet wrench as in claim 5 wherein the pawl includes a pair of notches which define the positioning surfaces.

7. A ratchet wrench as in claim 6 wherein the circular driver opening and pawl recess have a cylindrical shape.

8. A ratchet wrench as in claim 7 wherein the driver portion is a driving tang that projects outwardly past the second planar surface of the head.

9. A ratchet wrench as in claim 1 further including a detent mechanism having a ball mounted for inward and outward movement on the driving tang of the driver; said detent mechanism also including a detent member that is spring biased on the driver to normally force the ball outwardly to retain a driven member on the driving portion; said detent member being movable to permit inward movement of the ball in order to release the driven member on the driving portion.

10. A ratchet wrench as in claim 9 wherein the detent mechanism includes a helical compression spring through which the detent member extends, said helical compression spring having a first end that is seated by the driver and a second end that is seated by the detent member to provide the biasing thereof that forces the ball outwardly, and the detent member having a release button that is manually engaged to depress the detent member against the spring bias in order to release the ball for inward movement.

11. A ratchet wrench as in claim 10 wherein the detent member includes an end having an annular recess in which the ball is received and by which the ball is moved outwardly or permitted to move inwardly.

12. A reversible ratchet wrench comprising: a wrench body including a unitary head and a handle unitary with the head; the unitary head having first and second oppositely facing planar surfaces that define the maximum thickness of the head; the head also having a circular driver opening extending between the first and second oppositely facing planar surfaces; a pawl recess of a partially circular shape in the first planar surface adjacent the driver opening; the head having a pawl skirt that is unitary therewith and closes the pawl recess adjacent the second planar surface; the driver opening and pawl recess having a cylindrical shape; the driver opening having a larger size than the pawl recess; a driver having a round ratchet portion received within the circular driver opening and supported for rotation about a driving axis; the ratchet portion of the driver having teeth that extend continuously without interruption parallel to the driving axis between the first planar surface and the pawl skirt of the head; the driver including a flange rotatable therewith with respect to the head and having a planar retaining surface that engages the first planar surface of the head; a retainer on the driver; the retainer having a planar retaining surface for engaging the second planar surface of the head to cooperate with the flange in retaining the driver on the head; the driver also including a driving tang projecting along the driving axis outwardly past the second planar surface of the head; a detent mechanism including a ball mounted for inward and outward movement on the driving tang of the driver; said detent mechanism also including a detent member that is spring biased on the driver to normally force the ball outwardly to retain a socket on the driving tang; said detent member being movable to permit inward movement of the ball in order to release the socket from the driving tang; a pawl received within the pawl recess and supported thereby for rotation about a pawl axis between at least two positions; the pawl having oppositely facing planar surfaces; the planar retaining surface on the flange of the driver and the pawl skirt directly engaging the oppositely facing planar surfaces of the pawl to cooperate in retaining the pawl within the pawl recess; the pawl having spaced teeth that extend parallel to the driving axis to selectively engage the teeth of the ratchet portion of the driver to prevent rotation thereof with respect to the head in one direction or the other depending upon the pawl position; the pawl teeth extending the entire distance without interruption from the first planar surface of the wrench head to the pawl skirt and having ends that terminate at the pawl skirt in a spaced relationship to the second planar surface of the wrench head; the pawl having a tab for providing rotation thereof to change the direction of locking of the driver against rotation; the pawl including a pair of positioning surfaces spaced about the pawl, and an overcenter spring biaser including a ball and helical compression spring that biases the ball against the positioning surfaces of the pawl to position the pawl in order to maintain the pawl teeth in engagement with the ratchet teeth on the driver to prevent rotation of the driver in the opposite direction by ratcheting of the pawl.

13. A reversible ratchet wrench comprising: a wrench body including a unitary head and a handle; the unitary head having first and second oppositely facing planar surfaces that define the maximum thickness of the head; a circular driver opening extending between the first and second oppositely facing planar surfaces; a pawl recess of a partially circular shape in the first planar surface adjacent the driver opening; the head having a pawl skirt that is unitary therewith and closes the pawl recess adjacent the second planar surface; the driver opening and pawl recess having a cylindrical shape; the driver opening and pawl recess having a larger size than the pawl recess; a driver skirt extending radially inward toward a driving axis from the periphery of the driver opening at the second planar surface of the head; a driver having a round ratchet portion received within the circular driver opening and supported for rotation about the driving axis; the ratchet portion of the driver having teeth that extend parallel to the driving axis without interruption the entire distance between the first planar surface and the pawl and driver skirts; the driver including a flange rotatable therewith with respect to the head and having a planar retaining surface that engages the first planar surface of the head; a retainer on the driver; the retainer having a planar retaining surface for engaging the second planar surface of the head to cooperate with the flange in retaining the driver on the head; the driver also including a driving tang projecting along the driving axis outwardly past the second planar surface of the head; a detent mechanism including a ball mounted for inward and outward movement on the driving tang of the driver; said detent mechanism also including a detent pin that is spring biased on the driver to normally force the ball outwardly to retain a socket on the driving tang; said detent member being movable to permit inward movement of the ball in order to release the socket on the driving tang; said detent member being movable to permit inward movement of the ball in order to release the socket from the driving tang; a partially round pawl received within the pawl recess and supported thereby for rotation about a pawl axis between first and second positions; the pawl having oppositely facing planar surfaces; the planar retaining surface on the flange of the driver and the pawl skirt directly engaging the oppositely facing planar surfaces of the pawl to cooperate in retaining the pawl within the pawl recess; the pawl having spaced teeth that extend parallel to the driving axis to selectively engage the teeth of the ratchet portion of the driver to prevent rotation thereof with respect to the head in one direction or the other depending upon the pawl position; the pawl teeth extending the entire distance without interruption from the first planar surface of the wrench head to the pawl skirt and having ends that terminate at the pawl skirt in a spaced relationship to the second planar surface of the wrench head; the pawl having a tab for providing rotation thereof to change the direction of locking of the driver against rotation; the pawl including a pair of positioning surfaces spaced about the pawl; and an overcenter spring biaser including a ball and a helical compression spring that biases the ball against the positioning surfaces of the pawl to position the pawl in order to maintain the pawl teeth in engagement with the ratchet teeth on the driver to prevent rotation of the driver in the opposite direction by ratcheting of the pawl.

* * * * *